US006666058B2

(12) United States Patent
Gödel

(10) Patent No.: US 6,666,058 B2
(45) Date of Patent: Dec. 23, 2003

(54) METHOD AND DEVICE FOR MANUFACTURING A SURFACE-STRUCTURED PIPE CONDUIT ELEMENT

(75) Inventor: Frank Uwe Gödel, Stutensee (DE)

(73) Assignee: IWKA Balg- und Kompensatoren-Technoligie GmbH, Stutensee ( * ) Notice: Subject to any disclaimer, the term of this patent is extended or adjusted under 35 U.S.C. 154(b) by 0 days.

(21) Appl. No.: 10/153,204

(22) Filed: May 23, 2002

(65) Prior Publication Data

US 2003/0008073 A1 Jan. 9, 2003

(30) Foreign Application Priority Data

May 25, 2001 (DE) ..... 101 25 446
Jul. 26, 2001 (DE) ..... 101 36 347

(51) Int. Cl.[7] ..... B21D 3/00

(52) U.S. Cl. ..... 72/75; 72/78; 72/121; 72/126; 72/370.19; 72/370.2

(58) Field of Search ..... 72/52, 75, 78, 72/112, 121, 126, 191, 194, 370.19, 370.2

(56) References Cited

U.S. PATENT DOCUMENTS 3,735,615 A * 5/1973 Shneider ..... 72/75
4,383,429 A * 5/1983 Ceccacci ..... 72/318
4,794,775 A * 1/1989 Kuwahara et al. ..... 72/78
4,796,797 A * 1/1989 Nakako et al. ..... 228/144

* cited by examiner

*Primary Examiner*—Ed Tolan
(74) *Attorney, Agent, or Firm*—Paul Vincent

(57) ABSTRACT

A method for producing a, in particular thin-walled, pipe conduit element with a surface structure reinforcing the pipe conduit element is proposed wherein the pipe conduit element continuously passes by at least one embossing element guided about the periphery of the jacket thereof and the surface structure is embossed onto the jacket of the pipe conduit element by the embossing element using pure mechanical pressure. For embossing the surface structure onto the pipe conduit element, an arrangement of preferably several embossing elements, in particular balls or rollers are used which are distributed about the periphery of the pipe conduit element jacket. The invention also concerns a device for producing a surface structured pipe conduit element using a guidance having embossing elements and which can be rotated about the periphery of the jacket of a pipe conduit element continuously supplied to the device.

21 Claims, 1 Drawing Sheet

METHOD AND DEVICE FOR MANUFACTURING A SURFACE-STRUCTURED PIPE CONDUIT ELEMENT

BACKGROUND OF THE INVENTION

The invention concerns a method and a device for producing a preferably thin-walled pipe conduit element having a surface structure reinforcing the pipe conduit element.

To improve the mechanical properties of pipe conduit elements, in particular to increase the bending strength and pressure resistance, the pipe conduit element wall is conventionally retroactively provided with a surface structure through deformation, wherein the surface structure can be formed e.g. by a plurality of planes disposed next to each other in the longitudinal and peripheral directions or by concave contours with different normals to the surface. Deformation of the pipe conduit element of this type increases its stability in the respective regions such that the wall thickness may be less than that of flat-walled pipe conduit elements while satisfying the required mechanical properties. For many applications of such pipe conduit elements, the associated substantial material and cost reductions are of interest as is, in particular, the low overall weight. These pipe conduit elements are suited e.g. for return or exhaust gas lines of automotive vehicles to reduce operating costs due to their lightweight construction.

DE 196 54 618 C1 e.g. discloses a surface-structured pipe conduit element. The pipe conduit element has regions of cycloid cross-section disposed between round cross-sectional segments having concave, curved surfaces disposed in the longitudinal and also in the peripheral directions. They provide acoustical insulation, with their longitudinal separation depending on the wavelength of the sound waves which are to be damped.

Mechanical or hydraulic methods are conventionally used to produce pipe conduit systems of the above-mentioned type. DE 41 03 078 C2 discloses e.g. a device for hydrostatic deformation of pipe conduit elements.

SUMMARY OF THE INVENTION

DE 25 57 215 A1 describes a method for deforming thin-walled pipe conduit elements. The inner or outer side of a pipe section is thereby supported with abutting support elements in the form of rings or spirals and is loaded hydraulically or pneumatically with external or internal pressure to produce inwardly or outwardly directed deformations, disposed between the support elements.

Disadvantageously, the known methods are only suited for localized application of a surface structure to a finite pipe section of given length since the respective pipe section which is to be provided with a surface structure must be sealed for loading with pressurized fluid. In accordance with prior art, only discontinuous production of surface-structured pipe conduit elements is possible, with which the finished pipe conduit element must be cut to length and supplied to the respective deformation means. The handling involved is relatively demanding and the deformation device stoppage times are relatively long. Hydraulic deformation requires a large investment in tools and, in particular, extensive maintenance for the pressure generating and sealing means.

It is the underlying purpose of the invention to propose a simple and inexpensive method for producing a preferably thin-walled pipe conduit element with a reinforcing surface structure as well as a device for carrying out such a method which eliminate the above-mentioned disadvantages.

This object is achieved in accordance with the invention through process control with a method of the above-mentioned type in that the pipe conduit element is continuously fed past at least one embossing element, which is directed around the periphery of the pipe conduit element jacket to mechanically emboss the surface structure by pressing the embossing element onto the jacket of the pipe conduit element.

The invention fully departs from the known hydro-deformation methods in that the surface structure is embossed purely mechanically onto the jacket of the pipe conduit element by means of the embossing element which circulates radially about the pipe conduit element. The inventive method is particularly suited for simple and inexpensive continuous structuring of endless pipes, wherein the endless pipe is guided past the circulating embossing element at a predetermined speed and is deformed in a manner corresponding to the surface contour of the embossing element through pressure exerted by the embossing element onto the jacket of the pipe conduit element. The circulating embossing element can thereby be suitably disposed to be substantially stationary in the longitudinal direction of the pipe conduit element such that the surface structure results from overlap of the advance of the pipe conduit element with the rotation of the embossing element. The surface structure embossed onto the pipe conduit elements through the inventive method provides them with a bending strength and pressure resistance along their entire length which is better than that of a smooth-walled pipe conduit element. Due to their low weight, the elements are particularly suitable for the automotive industry.

In a preferred embodiment, rolling bodies in the form of balls and/or rollers are used as embossing elements. This keeps the friction produced during embossing of the surface structure as small as possible.

An arrangement of several embossing elements distributed about the periphery of the jacket of the pipe conduit element is advantageously used, wherein e.g. three or more preferably equidistantly disposed embossing elements are used between which the pipe conduit element is accommodated such that it is automatically centered during passage through the rotating arrangement of embossing elements, with all embossing elements exerting the same pressure onto the jacket of the pipe conduit element.

While the depth of the surface structure can be controlled by the pressure exerted and/or the feed travel of the embossing elements, the shape of the surface structure can be controlled by the rotational speed of the embossing elements, the guiding speed of the pipe element or by the surface contour of the embossing elements contacting the pipe conduit element.

The pipe conduit element can optionally be temperature-treated before embossing the surface structure. In addition to production of surface-structured pipe conduit elements from a cold deformable material, e.g. metal, this facilitates production of surface-structured plastic pipes. The plastic pipe is brought to an increased temperature at which it is e.g. in a plastic transition state to prevent brittle fracture due to the deformation forces exerted through contact with the embossing elements.

For single-step continuous production of a, in particular thin-walled, pipe conduit element having a surface structure reinforcing the pipe conduit element from a sheet layer, a further development provides that the layer forming the jacket of the pipe conduit element is continuously unwound from a spool, the layer is drawn into the pipe conduit element, the longitudinal edges of the layer are continuously connected, in particular welded, and the surface structure is then mechanically embossed onto the jacket of the pipe conduit element as described above.

The invention also concerns a device for producing a preferably thin-walled pipe conduit element having a surface structure reinforcing the pipe conduit element which is suitable for carrying out a method of the above-mentioned type. In accordance with the invention, the device is characterized by at least one rotatable guidance which is disposed about the periphery of the jacket of a pipe conduit element and which can be continuously fed to the device, with at least one embossing element for embossing the surface structure onto the pipe conduit element. The inventive device is of simple and inexpensive construction and permits continuous, purely mechanical structuring of the jacket of the pipe conduit element without using pressure generating or sealing means which are expensive with respect to investment costs and maintenance.

The embossing elements are preferably formed by balls and/or rollers with the guidance preferably accommodating several embossing elements. This can be ensured e.g. in that the guidance, which can rotate about the centrally guided pipe conduit element, is formed in the manner of a half-shell, ball bearing race or seat, with the embossing elements rolling between the guidance and the pipe conduit element. As an alternative, the embossing elements can also be borne on axles disposed on the circulating guidance which are axial with respect to the longitudinal axis of the pipe conduit element. The embossing elements are suitably disposed at substantially equal distances along the guidance to produce a uniform surface structure.

To vary the pressure of the embossing elements on the pipe conduit system or to adjust the device to pipe conduit elements with different outer diameters, the separation between the embossing elements and the center of the guidance can preferably be adjusted.

A preferred embodiment furthermore provides that the rotational speed of the guidance can be adjusted to provide, depending on the continuous feed of the pipe conduit element, at least a portion of the jacket of the pipe conduit element with surface deformations.

The embossing elements can be arranged for exchange thereof on the guidance to replace them when they are worn and to facilitate providing the guidance with embossing elements of different diameter and/or surface contour to thereby easily adjust the device to pipe conduit elements of differing diameters. This also permits production of different surface structures depending on the outer contour of the embossing elements used. Alternatively or additionally, the guidance may be replaceable for the same purpose.

A temperature adjustment means for the pipe conduit element can be optionally disposed upstream of the guidance having the embossing elements to ensure surface structuring of pipe conduit elements made from both cold deformable materials as well as from thermally plastifyable plastic materials.

In a further development, a drawing means is provided upstream of the guidance having the embossing elements to form the pipe conduit element from a layer, continuously unwound from a spool and with a welding means for subsequent welding of the longitudinal edges of the layer to form the pipe conduit element. This permits continuous production of the surface structured pipe conduit element from a band-shaped layer in one single step.

The invention is explained in more detail below by means of an embodiment with reference to the drawing.

DESCRIPTION OF THE PREFERRED EMBODIMENT

Figure 1:
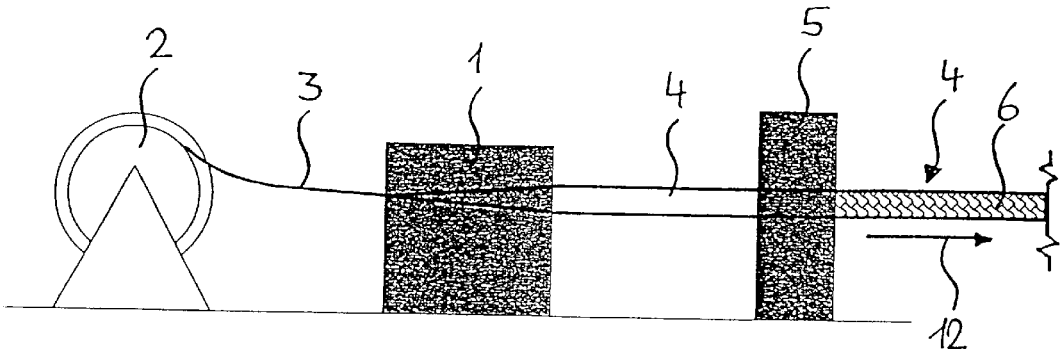
FIG. 1 shows a schematic view of a device for continuous production of a surface structured pipe conduit element and FIG. 2 shows a schematic detailed view of a rotatable guidance with embossing elements of the device in accordance with FIG. 1.

The device shown in FIG. 1 comprises a conventional drawing means 1 having a drawing tool and a welding means (not shown) to continuously produce a pipe conduit element 4 of approximately circular cross-section from a layer 3 which is unwound from a reel 2 by subsequently welding the longitudinal edges of the layer 3. The drawing means 1 is followed by a unit 5 for continuous mechanical embossing of a surface structure 6 onto the pipe conduit element 4 which has a rotatable guidance 7 disposed about the periphery of the jacket with embossing elements 8 (shown in detail in FIG. 2).

Figure 2:
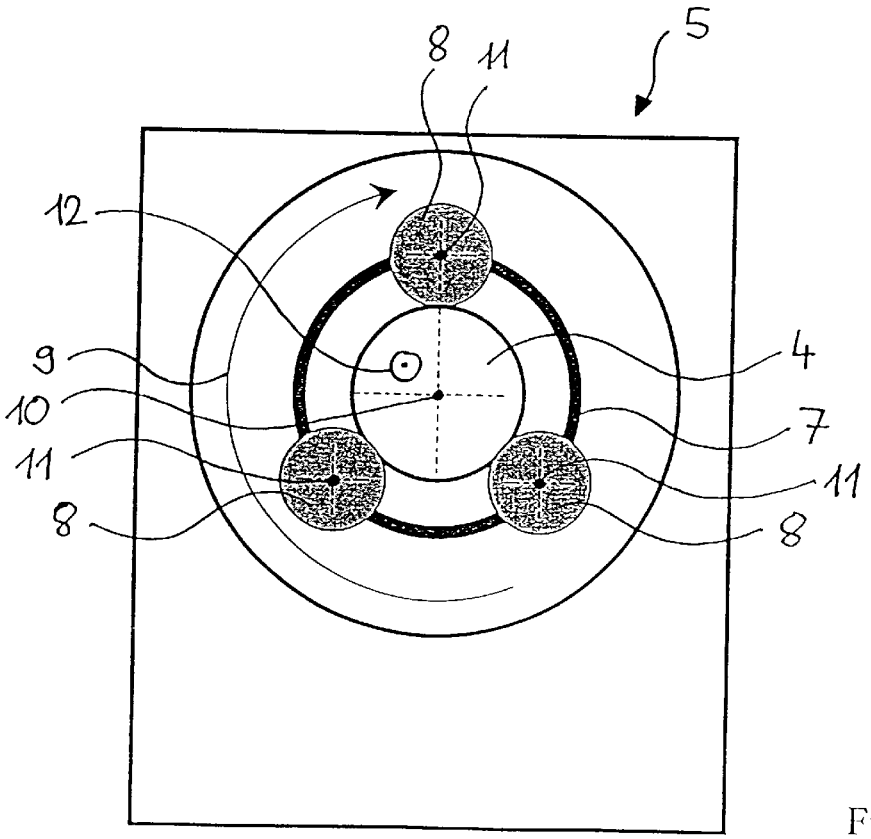

As shown in FIG. 2, the guidance 7 of the present embodiment is ring-shaped and can rotate about the periphery of the jacket of the pipe conduit element 4 (arrow 9). Three embossing elements 8 are disposed thereon at equal distances on axes 11, parallel to the longitudinal central axis 10 of the pipe conduit element 4. The embossing elements 8 are formed e.g. by balls or rollers and can be radially adjusted with respect to the pipe conduit element 4 to set the desired pressure. The rotational speed of the guidance 7 driven e.g. by an external drive (not shown) can be adjusted. The embossing elements 8 disposed on the axes 11 on the guidance 7 can, in particular, be exchanged for simple and quick replacement with embossing elements of another shape and/or diameter or to replace them when worn.

The function of the device is explained in more detail below:

For continuous production of the surface structured pipe conduit element 4, the layer 3 is continuously unwound from the reel 2 and formed into the pipe conduit element 4 by means of the drawing means 1 thereby welding the longitudinal edges of the layer 3, wherein the pipe conduit element 4 has an approximately round cross-section at this location which is defined by the cross-section of the drawing tool. The endless pipe conduit element 4 is then continuously fed to the guidance 7 of the unit 5 (directional arrow 12) having the embossing elements 8, wherein the guidance 7 is rotated such that the surface structure 6 is embossed onto the jacket of the pipe conduit element 4 by the embossing elements 8 circulating with the guidance 7 which are pressed onto the pipe conduit element 4.

The overlay of the rotation of the embossing elements 8 (arrow 12) with the advance of the pipe conduit element 4 (directional arrow 12) can produce structures on the jacket of the pipe conduit element 4 ranging from a uniform spiral embossing up to a honey-comb structure extending about the longitudinal central axis 11 of the pipe conduit element 4 like the thread of a screw in dependence on the feed of the rotating embossing elements 8 and their shape. The honeycomb structure of a plurality of subsequent concave deformations which are spirally disposed about the periphery of the jacket is thereby produced through displacement of the pipe material due to the pressure of the embossing elements. Periodic creases are formed in the pipe material at right angles to the relative speed of the pipe conduit element jacket with respect to the embossing elements. The shape and depth of the surface structures 6 can thereby be controlled by the rotational speed of the embossing elements 8 (arrow 9), the guiding speed of the pipe conduit element 4 (directional arrow 12) or the shape of the surface contour of the embossing elements 8 contacting it.

The pipe conduit element 4 with surface structure has an improved stability and rigidity compared to a smooth walled pipe conduit element. The wall thickness of the pipe conduit element 4 can be varied e.g. between approximately 0.1 mm and 0.8 mm, depending on the application.

| List of Reference Numerals | |
|---|---|
| 1 | Drawing means |
| 2 | reel |
| 3 | layer |
| 4 | pipe conduit element |
| 5 | unit |
| 6 | surface structure |
| 7 | guidance |
| 8 | embossing element |
| 9 | directional arrow |
| 10 | longitudinal central axis |
| 11 | axis |
| 12 | directional arrow |

I claim:

1. A method for producing a thin-walled pipe conduit element having a reinforcing surface structure, the method comprising the steps of:

a) adjusting a subsequently fixed radial separation of at least one embossing element from a longitudinal axis of said pipe conduit element in order to set a desired embossing pressure;

b) continuously passing the pipe conduit element past said embossing element;

c) rotating said embossing element about an outer surface of the pipe conduit element; and d) embossing the reinforcing surface structure on the pipe conduit element through an application of mechanical pressure alone, exerted by said embossing element onto said outer surface of the pipe conduit element.

2. The method of claim 1, wherein said embossing element comprises at least one ball or roller.

3. The method of claim 1, wherein an arrangement of several embossing elements is disposed about said outer surface of the pipe conduit element.

4. The method of claim 1, wherein said reinforcing surface structure has a depth controlled by said mechanical pressure exerted by said embossing element.

5. The method of claim 1, wherein said reinforcing surface structure has a depth controlled by a feed travel of said embossing element.

6. The method of claim 1, wherein said reinforcing surface structure has a shape controlled by a rotational speed of said embossing element.

7. The method of claim 1, wherein said reinforcing surface structure has a shape controlled by a guiding speed of the pipe conduit element.

8. The method of claim 1, wherein said reinforcing surface structure has a shape controlled by a surface contour of said embossing element contacting the pipe conduit element.

9. The method of claim 1, further comprising temperature treating the pipe conduit element prior to embossing said reinforcing surface structure in step d).

10. The method of claim 1, further comprising the steps of:

a1) continuously unwinding a layer of material from a reel;

a2) shaping said unwound layer into a pipe conduit element geometry using a drawing means; and a3) continuously connecting together longitudinal edges of said unwound layer to form the pipe conduit element.

11. The method of claim 10, wherein step a3) comprises welding together said longitudinal edges.

12. A device for producing a thin-walled pipe conduit element having a reinforcing surface structure, the device comprising:

means for adjusting a subsequently fixed radial separation of at least one embossing element from a longitudinal axis of said pipe conduit element;

means for continuously passing the pipe conduit element past said embossing element;

means for rotating said embossing element about an outer surface of the pipe conduit element; and means for embossing the reinforcing surface structure on the pipe conduit element through an application of mechanical pressure alone, exerted by said embossing element onto said outer surface of the pipe conduit element.

13. The device of claim 12, further comprising a rotatable guidance disposed about said outer surface of the pipe element, said guidance supporting said rotating means and said embossing means.

14. The device of claim 12, wherein said embossing element comprises at least one ball or roller.

15. The device of claim 13, wherein said guidance accepts several embossing elements.

16. The device of claim 15, wherein said several embossing elements are disposed at substantially equal distances along said guidance.

17. The device of claim 13, further comprising means for adjusting a rotational speed of said guidance.

18. The device of claim 13, further comprising means for disposing said embossing element on said guidance in a replaceable fashion.

19. The device of claim 13, wherein said guidance is replaceable.

20. The device of claim 13, further comprising temperature control means for the pipe conduit element disposed upstream of said guidance.

21. The device of claim 13, further comprising drawing means for shaping the pipe conduit element from a layer continuously unwound from a reel and with means for welding longitudinal edges of said layer to thereby form the pipe conduit element, wherein said welding means is disposed upstream of said guidance and downstream of said drawing means.

* * * * *